US011857069B1

(12) United States Patent
Coronado

(10) Patent No.: US 11,857,069 B1
(45) Date of Patent: Jan. 2, 2024

(54) APPARATUS AND METHOD FOR STORING JARS

(71) Applicant: Jaime Coronado, Roy, UT (US)

(72) Inventor: Jaime Coronado, Roy, UT (US)

( * ) Notice: Subject to any disclaimer, the term of this patent is extended or adjusted under 35 U.S.C. 154(b) by 0 days.

(21) Appl. No.: 17/878,814

(22) Filed: Aug. 1, 2022

(51) Int. Cl.
*A47B 81/00* (2006.01)
*A47B 73/00* (2006.01)

(52) U.S. Cl.
CPC ..... *A47B 81/007* (2013.01); *A47B 73/004* (2013.01)

(58) Field of Classification Search
CPC ..... A47B 81/007; A47B 73/00; A47B 73/004; A47B 73/008; A47F 5/0006; A47F 7/28; A47F 7/283; A47F 7/285; A47F 1/04; A47F 5/08
See application file for complete search history.

(56) References Cited

U.S. PATENT DOCUMENTS 1,618,821 A * 2/1927 Gruetter ..... B08B 9/426 248/312
2,028,694 A * 1/1936 Spinks ..... A47K 1/09 211/75
2,161,195 A * 6/1939 Potts ..... A47G 29/18 248/312
2,252,260 A * 8/1941 Jones ..... A47G 29/14 248/311.2
2,753,054 A * 7/1956 Becher ..... A47G 29/08 248/108
3,349,922 A * 10/1967 James ..... A47G 25/746 211/113
3,698,563 A * 10/1972 Gordon ..... A63B 60/60 211/70.1
4,019,638 A * 4/1977 Miller ..... A47F 5/0025 211/74
D294,442 S * 3/1988 Bordian ..... D6/528
D299,481 S * 1/1989 Handler ..... D6/534
4,834,248 A * 5/1989 Lee ..... A47F 5/0876 248/302
4,984,693 A * 1/1991 Belokin, Jr. ..... A47F 5/0876 D6/567
D320,123 S * 9/1991 Wolf ..... D6/528
D322,376 S * 12/1991 Simpson ..... D6/528
5,096,071 A * 3/1992 Neri ..... B01F 35/42 366/605
5,358,128 A * 10/1994 Belokin ..... F25D 25/02 211/75
D353,294 S * 12/1994 Belokin ..... D6/567
5,626,244 A * 5/1997 Mesna ..... E04H 17/066 211/85.7
5,655,673 A * 8/1997 Weterrings ..... A47F 7/283 211/74
D404,952 S * 2/1999 Bauer ..... D6/552
(Continued)

*Primary Examiner* — Devin K Barnett
(74) *Attorney, Agent, or Firm* — Lockhart IP; Curtis W. Lockhart

(57) ABSTRACT

An apparatus and method for storing jars is provided. The apparatus includes a base, two or more elongated side retaining members forming one or more channels, and a front retaining member. The apparatus is fastened to a surface by a plurality of fasteners. Jars are inserted and removed from the apparatus using a combination of rotational and translational motion. The device is unique in that it provides a means for quickly and conveniently storing jars without the need for additional components to retain the jars.

5 Claims, 6 Drawing Sheets

(56) References Cited

U.S. PATENT DOCUMENTS 5,865,326 A * 2/1999 Spamer ..... A47B 73/002 211/181.1
6,394,329 B1 * 5/2002 Magee ..... A45F 5/02 224/678
6,543,825 B1 * 4/2003 Dragutin ..... B65D 23/106 215/396
D489,586 S * 5/2004 Fitzsimmons ..... D7/701
6,749,074 B1 * 6/2004 Hileman ..... A47F 7/0028 211/85.7
6,808,149 B1 * 10/2004 Sendowski ..... A61J 1/16 248/312
7,017,759 B1 * 3/2006 Friend ..... A47B 73/00 248/312
7,464,907 B1 * 12/2008 Lane ..... A47K 1/09 248/312.1
7,744,053 B2 * 6/2010 Perman ..... A45F 5/021 248/312
8,607,994 B1 * 12/2013 Schneider ..... A47B 73/002 211/106.01
9,834,960 B2 * 12/2017 Chesterton ..... A63C 17/0006
10,575,625 B2 * 3/2020 Senn ..... A45F 5/021
D887,796 S * 6/2020 Chiang ..... D7/701
D888,411 S * 6/2020 Roh ..... D3/215
D945,172 S * 3/2022 Murray ..... D6/323
2005/0082456 A1 * 4/2005 Petri ..... B65G 17/323 248/312
2007/0023371 A1 * 2/2007 Noga ..... A47B 81/00 211/75
2014/0117184 A1 * 5/2014 Sharpe ..... A61J 1/16 248/313
2016/0157606 A1 * 6/2016 Kaelin ..... A47B 73/00 211/74
2020/0000224 A1 * 1/2020 Di Prima ..... A47B 73/004
2021/0219719 A1 * 7/2021 Jensen ..... A47B 73/00

* cited by examiner

APPARATUS AND METHOD FOR STORING JARS

CROSS-REFERENCE TO RELATED APPLICATION

This application claims the benefit of U.S. Provisional Patent Application No. 63/228,003, filed Jul. 30, 2021, which is incorporated by reference herein in its entirety.

COPYRIGHT AND TRADE DRESS NOTICE

A portion of the disclosure of this patent document contains material which is subject to copyright or trade dress protection. This patent document may show and/or describe matter that is or may become trade dress of the owner. The copyright and trade dress owner has no objection to the facsimile reproduction by anyone of the patent disclosure, as it appears in the Patent and Trademark Office patent files or records, but otherwise reserves all copyright and trade dress rights whatsoever.

BACKGROUND

1. Field of the Invention

The present invention relates generally to food storage devices, and more specifically, to an apparatus and method for securely retaining canning jars for quick and convenient releasable access.

2. Description of Related Art

This background information is intended to further educate the reader as to additional aspects of the prior art and may present examples of specific aspects of the prior art that is not to be construed as limiting the disclosure of the present application.

Food storage racks and other retaining devices are known in the art and are an effective means for storing a container or other object for convenient access when in need. However, known devices often face a challenge between ease of access and retention of the stored object. For example, a rack for storing containers may employ a removable plug to prevent the containers from inadvertently sliding off the rack. This creates additional steps for a user to go through to access the containers when needed which is less convenient and requires more time and effort from the user. Additionally, the removable plug may be small and easily misplaced or lost rendering the device less effective or entirely unusable. Other known devices may store containers at an angle such that the containers cannot inadvertently fall off the storage device. However, such devices often leave the stored containers in a position that is not convenient to retrieve when the containers are needed.

Accordingly, although great advances have been made in the area of food storage and retaining devices, there are deficiencies that remain.

SUMMARY

The disclosure of the present application addresses the above stated deficiencies with storage racks and other retaining devices. The apparatus and method for storing jars of the present application is unique when compared with other known storage racks because it allows a user to store and release a canning jar without the risk of the jar inadvertently falling off the rack quickly and easily.

The system of the present application includes a base, a front retaining member and at least two side retaining members. The base is configured to fasten to a surface such as a wall and support the rack. The side retaining members are attached at a first end substantially perpendicular to the base and are substantially parallel to the other side retaining members such that two side retaining members form a channel configured to receive and support a canning jar. The front retaining member is attached to the side retaining members at a second end and configured to prevent the canning jars from inadvertently falling off the rack.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
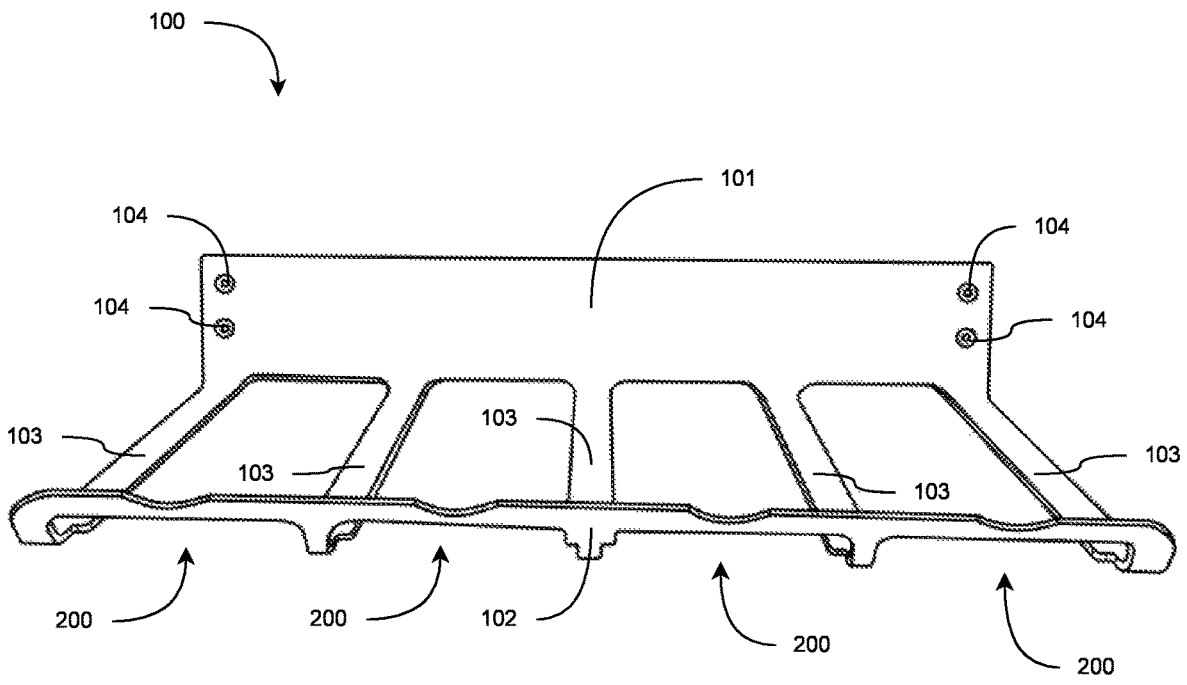
FIG. 1 is a front view illustrating an apparatus for storing jars in accordance with a preferred embodiment of the present application.
Figure 2:
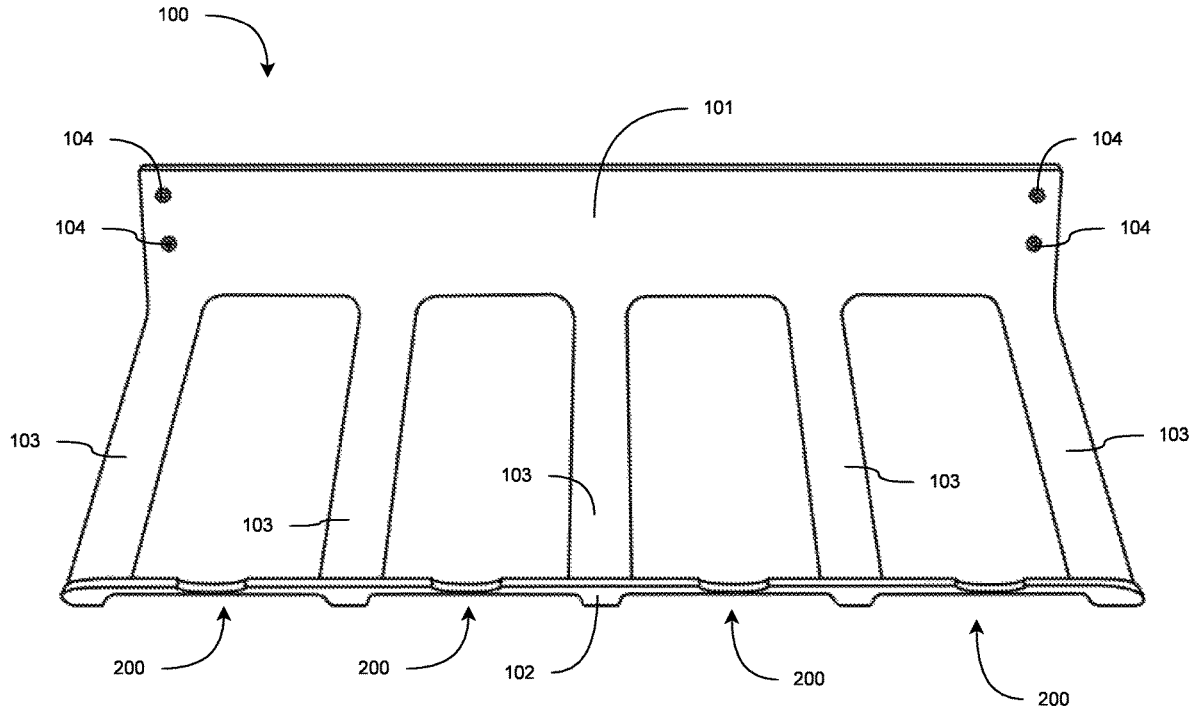
FIG. 2 is a front-top view illustrating the apparatus for storing jars.
Figure 3:
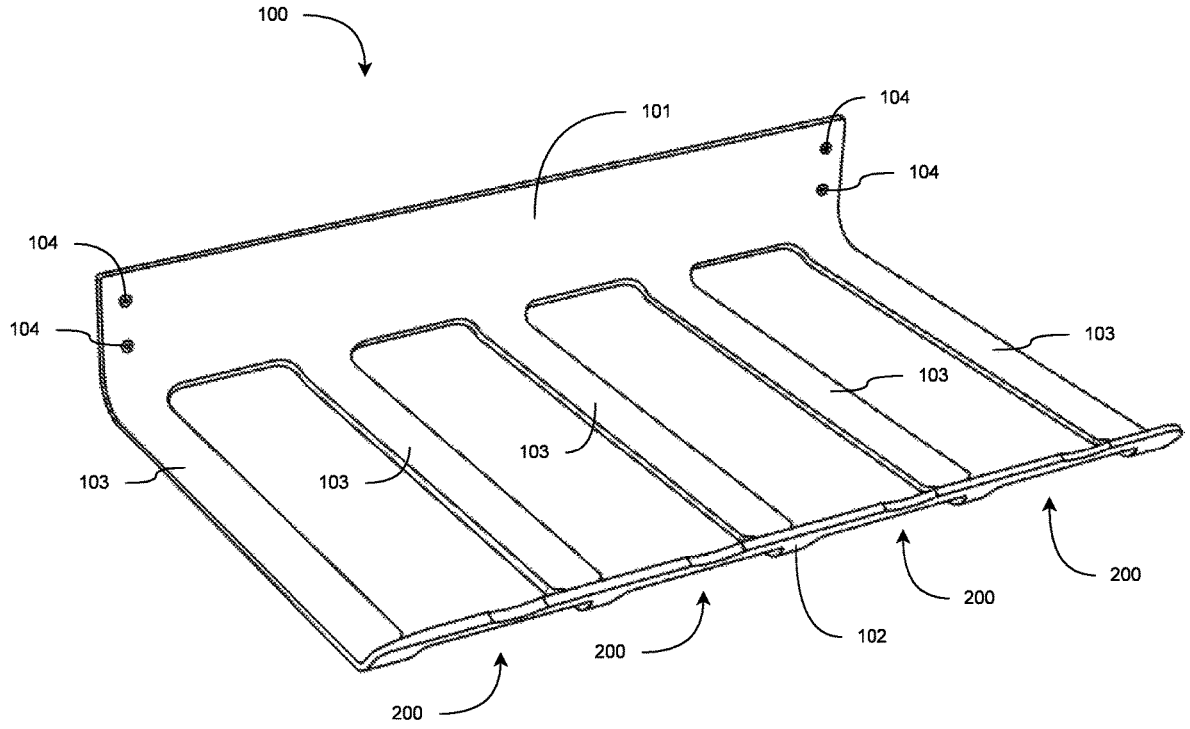
FIG. 3 is a front-left perspective view illustrating the apparatus for storing jars.
Figure 4:
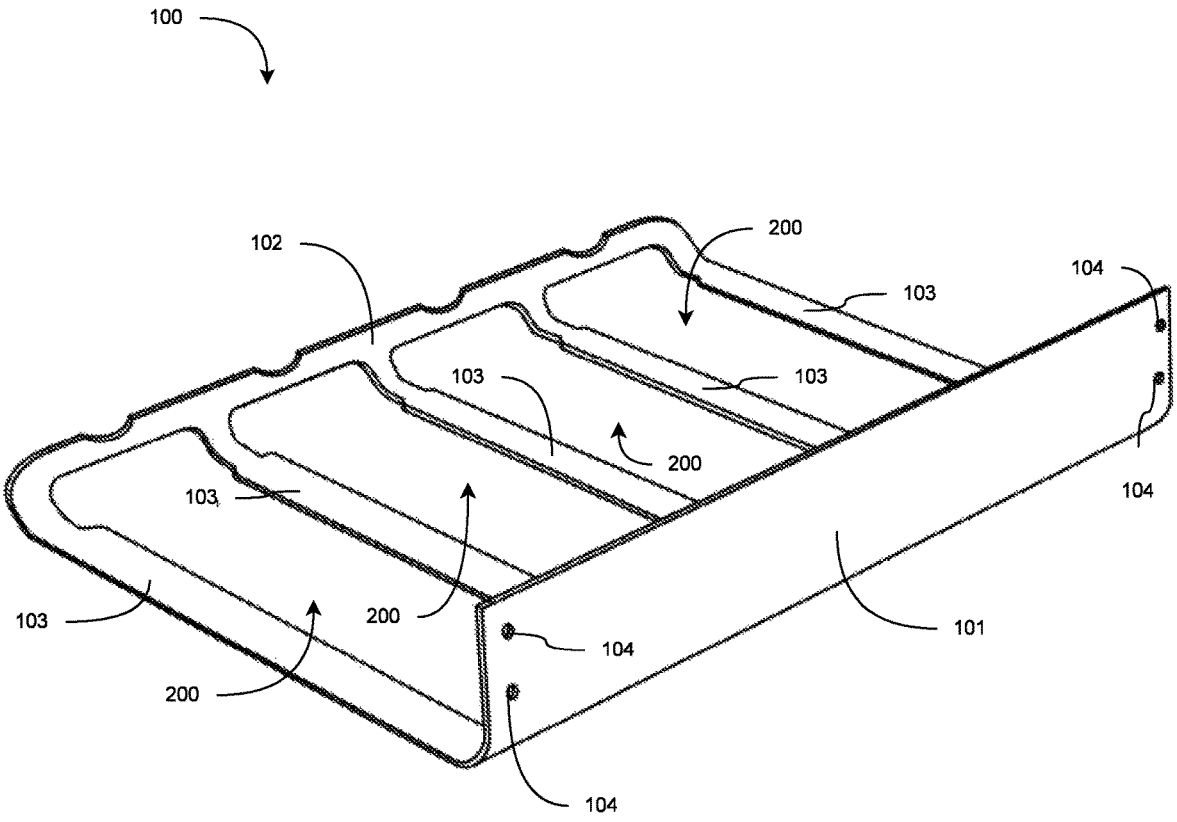
FIG. 4 is a back-right perspective view illustrating the apparatus for storing jars.
Figure 5:
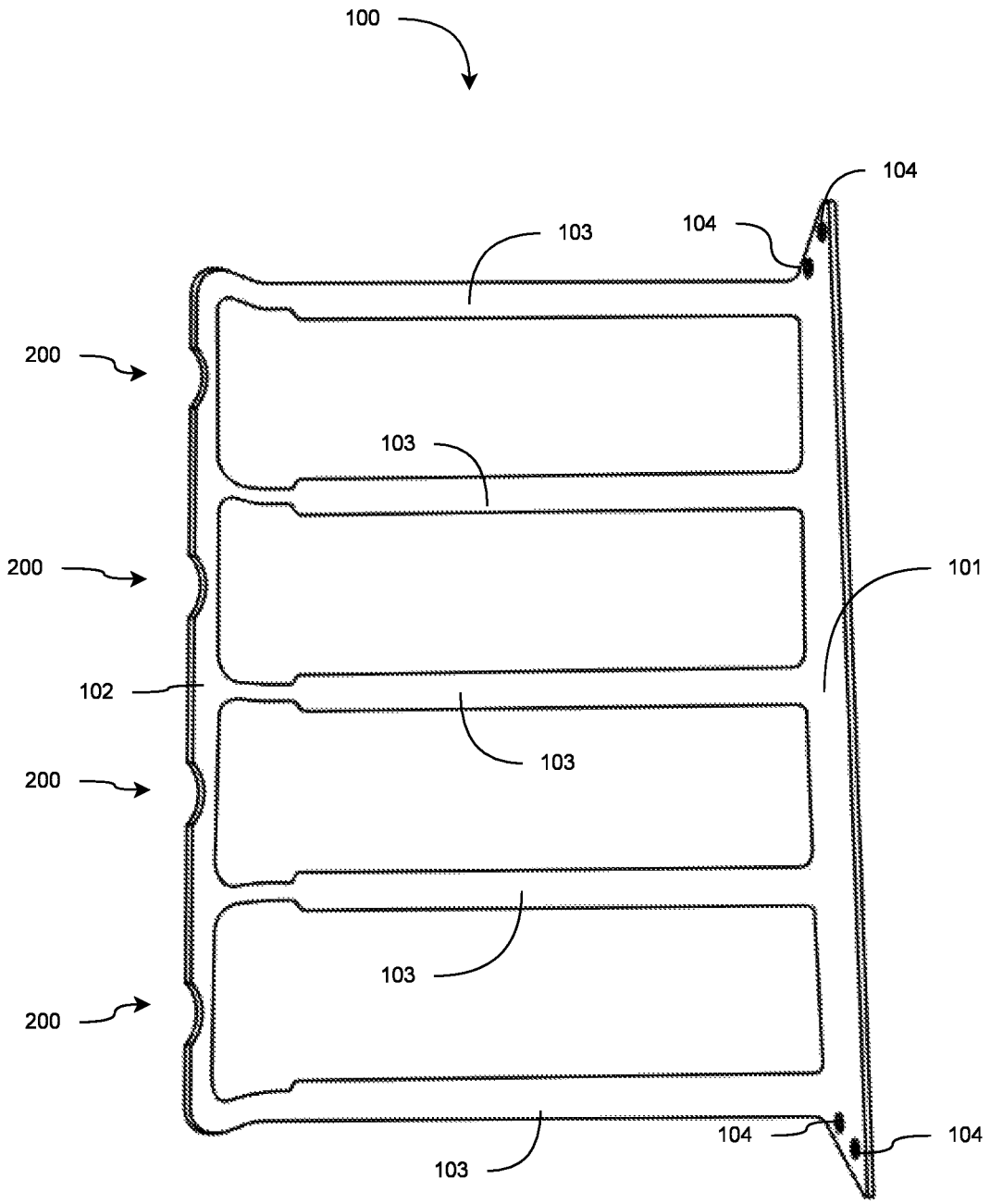
FIG. 5 is a top view illustrating the apparatus for storing jars.
Figure 6:
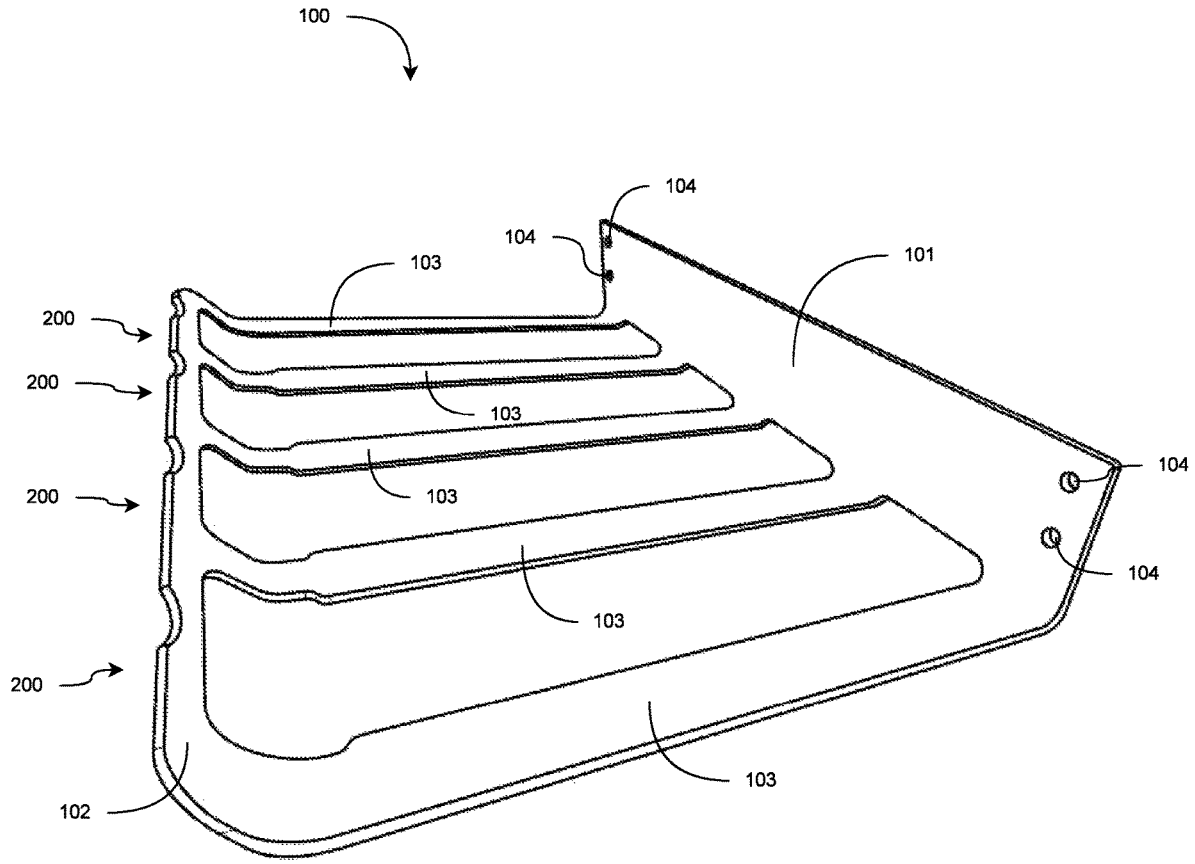
FIG. 6 is a right side view illustrating the apparatus for storing jars.

While the system of the present application is subject to various modifications and alternative forms, specific embodiments have been shown by way of example in the drawings and are described in detail. It should be understood that the description of specific embodiments is not intended to limit the invention to the particular embodiment disclosed, but rather to cover all modifications, equivalents, and alternatives falling within the scope of the present application as defined by the appended claims.

DETAILED DESCRIPTION

Illustrative embodiments of the system of the present application are provided herein. It should be appreciated that in the development of any actual embodiment, various implementation-specific decisions are required to achieve the developer's specific goals, such as compliance with system-related and business-related constraints, which vary from one implementation to another. Moreover, it should be appreciated that such a development effort might be complex and time-consuming but would nevertheless be a routine undertaking for those of ordinary skill in the art having the benefit of this disclosure.

The system in accordance with the present application overcomes one or more of the above-discussed shortcomings commonly associated with conventional food storage racks. Specifically, the apparatus and method for storing jars incorporates a means for quick and convenient access to canning jars without risk of the canning jars inadvertently falling off the rack. These and other unique features of the system are discussed below and illustrated in the accompanying drawings.

The system should be understood, both as to its structure and operation, from the accompanying drawings, taken in conjunction with the accompanying description. Various embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the various views, FIG. 1 depicts a front view of an apparatus for storing jars 100 in accordance with an embodiment of the present application. Apparatus 100 includes a base 101, a front retaining member 102 and two or more side retaining members 103. Base 101 provides support for the rack and may be fastened to a surface such as a wall or other similar surface for convenient access for a user by fasteners 104. The side retaining members 103 are connected at a first end substantially perpendicular to the base 101 and extend substantially parallel to each other and away from the base 101. Two side retaining members 103 form a channel 200 that is configured to receive and secure a canning jar wherein one side retaining member 103 secures one side of a jar and another side retaining member 103 secures an opposite side of the jar. The front retaining member 102 is connected to a second end of the side retaining members 103 at an angle such that the canning jars are secured within the channels 200 formed by the side retaining members 103. The canning jars are inserted and removed from the channels 200 through a rotational and translational movement by sliding each jar along a channel 200.

Apparatus 100 may be secured to virtually any supporting structure such as a wall, a cabinet and a cart via fasteners such as screws and bolts or the like.

The angle between the base 101 and the side retaining members 103 is about 85° and may be between 80° and 90°. The angle between the front retaining member 102 and each of the side retaining members 103 is about 152° and may be between 144° and 160°. The width of each channel 200 is slightly less than the outer diameter of the rim of each canning jar, thus allowing the channel 200 to retain the jar by a side retaining member 103 on opposite sides of the rim of the jar. At the intersection of the front retaining member 102 and the side retaining members 103, the width of the channel 200 expands on either side to allow the user to slide the jar in and out of the channel 200.

It should be appreciated that one of the unique features of the disclosure of the present application is the ability for the user to retain canning jars for quick access while the jars are secure from inadvertently falling off the rack. This is accomplished by the combination of rotational and translational movement required to insert and remove the jars from apparatus 100.

Each jar is secured in a channel 200 via pivot points along the rim of the jar. To place a jar along a channel 200 supported by two side retaining members 103, the jar may have a side oriented toward the rear portion of the channel 200 raised and the opposite side of the jar lowered through rotation allowing the rim of the jar to slide onto the pivot points of the connecting portion. The jar is then rotated in an opposite direction of the initial rotation of the jar and the jar slides along the channel 200 supported by two side retaining members 103. To remove a jar, the user reverses this process.

For a given height of the top of a jar above the top of the rim of the jar, two dimensions are important for place and removing the jar along the channel 200: (1) the horizontal distance between the pivot points and the rear of the front retaining member 102 and (2) the vertical height between the bottom of the front retaining member 102 and the pivot points. The bottom of the front retaining member 102 may be either above or below the pivot points. The front retaining member 102 should not be above the top of a stored jar nor below the bottom of a stored jar.

The perimeter of most canning jars expands outward below the rim of the jar. The thickness of the side retaining members 103 may be selected to be less than the vertical distance between the rim and the outward expansion of the jar, thereby precluding a jar from being removed vertically upward from the side retaining members 103. Some canning jars may not have their perimeter expanding below the rim or even have their perimeter recede below the rim allowing such jars to be removed vertically from the side retaining members 103.

In one embodiment, an upwardly or downwardly elongated rear member extends across the rear of one or more channels 200 from one side retaining member 103 to another, thus terminating one or more channels 200.

In one embodiment, the rear portion may be a mirror image of the front portion creating, between a rear portion and a storage portion, a second connecting portion which is a mirror image of the connecting portion between the front portion and the storage portion. This embodiment allows a jar to be placed along a channel 200 from the front and removed from the back and vice versa allowing rotation of the stored jars without removing one jar. This creates an easy method for rotating filled jars on a first-in first-out basis so that the oldest contents are utilized first, thereby reducing the possibility for spoiling when the contents of the stored jars are perishable.

In one embodiment, the front retaining member 102 may be higher than the side retaining members 103 creating a depression for holding the neck of a wine bottle or the like in the highest portion of the front retaining member 102 and is substantially aligned with the longitudinal center of the corresponding channel 200. The channel 200 may hold a bottle with the lowest portion of the bottle inside the channel 200 for stability. In a preferred embodiment, the depression is in the shape of a minor segment of a circle.

The particular embodiments disclosed herein are illustrative only, as the embodiments may be modified and practiced in different but equivalent manners apparent to those skilled in the art having the benefit of the present disclosure. It is therefore evident that the particular embodiments disclosed herein may be altered or modified, and any such variations are considered to fall within the scope of the present application. Accordingly, the protection sought herein is as set forth in the description and the appended claims as well as any other variations and modifications falling within the scope thereof.

What is claimed is:

1. An apparatus for storing jars, comprising:

a base configured to connect to a surface via a plurality of fasteners;

two or more elongated side retaining members substantially perpendicularly connected to the base at a first end;

a front retaining member substantially perpendicularly connected to a second end of the two or more elongated side retaining members, wherein a first elongated side retaining member is substantially parallel to a second elongated side retaining member, the two or more side retaining members include the first elongated side retaining member and the second elongated side retaining member, the first elongated side retaining member and the second elongated side retaining member form a channel configured to receive and store a jar, an angle formed by a connection between the two or more elongated side retaining members and the front retaining member is between 144° and 160°, the front retaining member extends along an entire width of the channel.

2. The apparatus for storing jars of claim 1, wherein an angle formed by the connection between the base and the two or more side retaining members is between 80° and 90°.

3. The apparatus for storing jars of claim 2, wherein the angle formed by the connection between the base and the two or more side retaining members is about 85°.

4. The apparatus for storing jars of claim 1, wherein the angle formed by the connection between the two or more side retaining members and the front retaining member is about 152°.

5. A method for storing jars, the method comprising:

providing the apparatus for storing jars of claim 1;

fastening the apparatus for storing jars to a surface;

inserting a jar into the channel of the apparatus for storing jars using a combination of rotational and translational motions;

removing the jar from the channel of the apparatus for storing jars using a combination of rotational and translational motions opposite the motions required in the step for inserting the jar.

* * * * *